US006488056B2

(12) United States Patent
Mason

(10) Patent No.: US 6,488,056 B2
(45) Date of Patent: Dec. 3, 2002

(54) MEDICAL LIQUID OXYGEN STORAGE, DISPENSING, AND BILLING SYSTEM AND METHOD

(75) Inventor: Thomas Mason, Fairfield, CT (US)

(73) Assignee: Technical Gas Products, Stratford, CT (US)

( * ) Notice: Subject to any disclaimer, the term of this patent is extended or adjusted under 35 U.S.C. 154(b) by 0 days.

(21) Appl. No.: 09/930,380

(22) Filed: Aug. 15, 2001

(65) Prior Publication Data

US 2002/0083996 A1 Jul. 4, 2002

Related U.S. Application Data

(62) Division of application No. 09/598,101, filed on Jun. 21, 2000, now Pat. No. 6,311,738.

(51) Int. Cl.[7] ..... B65B 1/04

(52) U.S. Cl. ..... 141/2; 141/94; 705/412; 222/23

(58) Field of Search ..... 141/2, 18, 94, 141/95, 98, 231; 222/36, 37, 23; 705/30, 34, 400, 412, 413

(56) References Cited

U.S. PATENT DOCUMENTS

| | | | | |
|---|---|---|---|---|
| 2,443,724 | A | 6/1948 | Cibulka | |
| 2,500,249 | A | 3/1950 | Hansen | |
| 2,500,320 | A | 3/1950 | Peff | |
| 2,907,176 | A | 10/1959 | Tsunoda et al. | |
| 2,945,354 | A | 7/1960 | Moskowitz | |
| 3,263,433 | A | 8/1966 | Fitt | |
| 3,797,262 | A | 3/1974 | Eigenbrod | |
| 3,898,853 | A | 8/1975 | Iung | |
| 3,925,048 | A | 12/1975 | Iung | |
| 4,175,395 | A | 11/1979 | Prost et al. | |
| 4,897,226 | A | 1/1990 | Hoyle et al. | |
| 5,467,603 | A | 11/1995 | Lehman et al. | |
| 5,894,742 | A | 4/1999 | Friedt | |
| 5,924,291 | A | 7/1999 | Weiler et al. | |
| 5,954,101 | A | 9/1999 | Drube et al. | |
| 6,351,737 | B1 * | 2/2002 | Williams | 705/30 |

* cited by examiner

*Primary Examiner*—Steven O. Douglas
(74) *Attorney, Agent, or Firm*—Barry R. Lipsitz; Douglas M. McAllister

(57) ABSTRACT

A method and system for the storage and dispensing of medical grade liquid oxygen are provided. Medical grade liquid oxygen is stored in a storage tank located within a medical facility which is capable of dispensing liquid oxygen to portable liquid oxygen reservoirs and to portable liquid oxygen tanks, as well as delivering oxygen gas through a gas pipeline network. The storage tank is filled through a fill station exterior to the facility. A fixed price billing method is provided for the cost of the liquid oxygen delivered for use in the system. Economical storage, delivery and billing services are thereby provided to medium sized facilities such as nursing homes or extended care facilities which utilize both liquid and gaseous oxygen but cannot afford to install the very large exterior liquid oxygen tanks used by major hospitals and research facilities. Increased safety in the storage and dispensing of the liquid oxygen is provided in accordance with the present invention.

5 Claims, 3 Drawing Sheets

EXTERIOR FILL STATION

MEDICAL LIQUID OXYGEN STORAGE, DISPENSING, AND BILLING SYSTEM AND METHOD

This application is a divisional of U.S. patent application Ser. No. 09/598,101, now U.S. Pat. No. 6,311,738, filed on Jun. 21, 2000.

BACKGROUND OF THE INVENTION

The present invention relates to a method and system for the storage and dispensing of medical grade liquid oxygen, as well as a method of billing in connection therewith. In particular, the present invention relates to the storage of medical grade liquid oxygen in a storage tank located within a medical facility which is capable of dispensing liquid oxygen to portable liquid oxygen reservoirs or to portable liquid oxygen tanks, and delivering oxygen gas through a gas pipeline network. A fixed price billing method is provided for the cost of the liquid oxygen delivered for use in the system.

In prior art systems such as those used by major hospitals or other health care facilities, liquid oxygen is normally stored in very large (i.e. 1,500 to 2,500 gallon) tanks located exterior to the hospital or healthcare facility. Such tanks are normally used to deliver only oxygen gas through a gas pipeline. The gas pipeline may be routed to deliver oxygen gas to a surgical center for delivery to a surgery patient, to a laboratory, or directly to a patient's room for direct delivery to the patient. Such facilities normally use portable liquid oxygen reservoirs to fill small portable liquid oxygen tanks with liquid oxygen for portable use by a patient. A standard portable liquid oxygen reservoir normally holds approximately 10 gallons of liquid oxygen. A portable liquid oxygen tank holds approximately 1 liter of liquid oxygen. The portable liquid oxygen tanks are provided with vaporizing mechanisms which enable a patient to obtain oxygen gas from the portable liquid oxygen tanks. One gallon of liquid oxygen is equivalent to 115 cubic feet of oxygen gas.

Although such large exterior storage systems may allow for dispensing of liquid oxygen into portable liquid oxygen reservoirs, the portable liquid oxygen reservoirs in such systems must typically be brought outside to the storage tank for filling. Alternatively, the hospital or healthcare facility will have the portable liquid oxygen reservoirs filled independently of the large exterior storage tank, typically by a separate delivery from that which fills the exterior tank. Normally the portable liquid oxygen reservoirs must be brought outside for filling at curbside from the delivery truck. Thus, such a system requires separate liquid oxygen delivery to the portable reservoirs and the large exterior storage tank.

Accordingly, liquid oxygen delivery costs for such facilities are high as two separate types of delivery trucks may be necessary, each with fittings adapted to either the exterior storage tank or the portable liquid oxygen reservoirs. In addition, the delivery trucks used to deliver liquid oxygen to the large exterior storage tanks are costly due to the large volume capacity of the trucks required to fill such large exterior tanks, as wells as the fittings, transfer pumps, and metering apparatus required for the dispensing of the liquid oxygen.

Smaller healthcare facilities may only use portable liquid oxygen reservoirs. These reservoirs are typically filled from smaller delivery vehicles holding approximately 100 to 120 gallons of liquid oxygen. The portable reservoirs must be brought outside to the delivery vehicle for filling. In addition, more frequent deliveries may be required where a facility only maintains a limited number of portable reservoirs having a 10 gallon capacity. As a result, delivery and manpower costs associated with filling the portable liquid oxygen reservoirs can be high. Such costs are of course passed on to the healthcare facility.

In addition, the initial costs of exterior storage systems are very high, as the installation of such large exterior storage tanks normally requires excavation work and the erection of a specially constructed concrete foundation and surrounding fencing.

The costs of installing a large exterior tank storage system in facilities such as nursing homes, extended care facilities, or other small healthcare facilities is typically prohibitive. Typically, a nursing home will have several portable liquid oxygen reservoirs which are filled periodically at each delivery. This results in several portable liquid oxygen reservoirs being filled to capacity at the same time. As a result, liquid oxygen will tend to boil off and escape from the portable liquid oxygen reservoirs over time, resulting in waste.

An additional concern associated with the use of the portable liquid oxygen reservoirs is safety. The more a portable reservoir is moved the more likely it is to be damaged. As existing systems require the portable reservoirs to be brought outside of the facility for each filling, the potential for damage to the reservoir is increased. Further, the storage of multiple reservoirs increases a facilities risk of accident due to the possibility of malfunction with respect to each reservor. It would be advantageous to provide a system that allows for filling of a portable liquid oxygen reservoir at a nursing home or other facility only as needed. This would reduce the number of portable liquid oxygen reservoirs needed by the facility and consequently reduce the number of such portable reservoirs which need to be filled and stored safely for a period of time.

It would be further advantageous to provide a method and system for the storage and dispensing of medical grade liquid oxygen having a storage tank located within the medical facility. The storage tank should be adapted to allow connection to both an oxygen gas pipeline for delivery of oxygen gas to remote locations within the medical facility and one or more fill stations for filling either a portable liquid oxygen reservoir or a portable liquid oxygen tank. The storage tank of such a system should include a mechanism to prevent the liquid oxygen from being completely drained from the tank so that the supply of oxygen gas to the gas pipeline (i.e. the oxygen gas piped directly to a patient's bedside) is not depleted when filling portable reservoirs or tanks. It would be still further advantageous to provide a mechanism for connecting an interior liquid oxygen storage tank to a remote fill station, located on the exterior of the medical facility, for delivery of the liquid oxygen into the storage tank.

It would be further advantageous to increase the safety of liquid oxygen delivery systems by reducing the number of portable reservoirs which are stored at a facility and eliminating the need to transport the reservoirs outside of the facility for filling.

The storage tank for use in the interior of a facility may be limited in size by various state and federal regulations to approximately 170 gallons of liquid oxygen (See, for example, regulations promulgated by The National Fire Protection Association). Therefore, it would be advantageous to limit the size of the liquid oxygen storage tanks to approximately 160 gallons. Smaller storage tanks can be provided in accordance with the needs of the facility.

The system of the present invention provides the aforementioned and other advantages.

As the liquid oxygen storage and dispensing system of the present invention provides liquid oxygen more economically and safely at a significantly lower cost than conventional systems used to deliver medical grade liquid oxygen, a fixed price billing plan for use in connection with the present invention is also disclosed, wherein oxygen delivery is provided to a medical facility for a fixed price per period based on prior usage estimates.

The storage, dispensing, and billing system of the present invention overcomes the disadvantages of prior art systems by combining the storage and delivery of liquid oxygen and oxygen gas into one system. Therefore, costs associated with delivery are reduced and safety is increased. The large liquid oxygen delivery truck capable of filling the 1,500 to 2,500 gallon exterior tanks, which are equipped with specialized transfer pumps and metering apparatus, are no longer needed to fill the smaller (e.g. 160 gallon) tanks used with the present invention.

In addition, since the billing for delivery of the liquid oxygen is based on a fixed price per period, expensive transfer pumps and metering apparatus on the delivery trucks are no longer needed. At the time of filing the present application, such conventional delivery trucks with transfer pumps and metering apparatus typically cost approximately $150,000.00 each. The delivery trucks needed to fill the storage tank of the present invention presently cost approximately $30,000.00 each.

Additionally, costs associated with installation of the system are reduced. The storage tank of the present invention is sized so as not to require a special foundation but is large enough to handle the typical liquid oxygen usage of a nursing home, small hospital, or similar facility. Oxygen loss through boil off during prolonged storage in the portable liquid oxygen reservoirs is reduced as well.

Moreover, since the present invention allows the portable liquid oxygen reservoirs to be filled from a fill station located within the facility, these portable reservoirs no longer need to be brought out to a delivery truck for filling, thereby increasing safety and reducing manpower requirements and delivery costs. In addition, the present system provides a method to control the maximum volume of liquid oxygen located in a facility at a given time (i.e. the maximum volume would be the total of the maximum volume of the storage tank, the portable reservoirs, and the portable tanks located at a facility).

Further, the storage of a facility's liquid oxygen in an interior storage tank is safer than storage of the liquid oxygen in numerous portable reservoirs, as the interior storage tank of the type used in the present invention is built to more demanding specifications (as determined by governmental regulation) than those of the portable reservoirs. Also, by avoiding the use of numerous reservoirs for the storage of liquid oxygen, a facility can reduce the number of variables which can factor into potential accidents (i.e. each portable reservoir has its own connections and fittings which may be defective or become damaged).

SUMMARY OF THE INVENTION

The present invention relates to a method and system for the storage and dispensing of medical grade liquid oxygen. In particular, the present invention relates to the storage of medical grade liquid oxygen in a storage tank located within a medical facility which is capable of dispensing liquid oxygen to portable liquid oxygen reservoirs and to portable liquid oxygen tanks, as well as delivering oxygen gas through a gas pipeline distribution network. A fixed price billing method is provided for the cost of the liquid oxygen delivered for use in the system.

In an illustrated embodiment, a medical liquid oxygen storage and dispensing system is provided. A liquid oxygen storage tank is located inside a facility. An exterior fill station is provided on the exterior or the facility and connected to the storage tank. A gas pipeline distribution network is connected to the storage tank for delivery of oxygen in gaseous form directly to various locations throughout the facility (e.g. operating rooms, patient rooms, laboratory facilities, and the like). An interior fill station is provided within the facility and connected to the storage tank for dispensing liquid oxygen from the storage tank into portable liquid oxygen reservoirs (such as the portable liquid oxygen reservoirs manufactured by Nellcor Puritan Bennett, Model Nos. 31A or 41A). A pipeline connecting the interior fill station to the storage tank is provided with a valve mechanism which prevents the liquid oxygen from being completely drained from the storage tank. This ensures that a gaseous oxygen supply is provided to the gas pipeline distribution network without interruption.

The valve mechanism may comprise a dip tube with a float valve disposed at the end of the pipeline which is located inside the storage tank and arranged at a level above a bottom level of the storage tank, such that the float valve acts to close the pipeline when the liquid oxygen is drawn down to a preset level by the interior fill station.

The invention also can be used with multiple interior fill stations for portable liquid oxygen reservoirs. Interior fill stations may also be provided within the facility and connected to the storage tank for dispensing liquid oxygen into portable liquid oxygen tanks (such as the portable liquid oxygen tanks manufactured by Nellcor Puritan Bennett, Model No. C1000) which can be carried by patients. Portable oxygen tanks can also be filled with liquid oxygen from the portable liquid oxygen reservoirs.

In a further embodiment of the invention, the exterior fill station has a fill connection for providing liquid oxygen from a delivery truck to the storage tank. One or more pressure relief valves are provided for venting oxygen gas in the event of an overpressure. A pressure indicator is provided which indicates the pressure of the oxygen gas in the storage tank and a tank level indicator is provided which indicates the level of liquid oxygen in the storage tank. A vent/full trycock valve is provided which prevents overfilling of the storage tank with liquid oxygen.

The exterior fill station may also be provided with a sample valve which allows oxygen gas from the storage tank to be withdrawn.

In another embodiment, the interior fill station for dispensing liquid oxygen from the storage tank into portable liquid oxygen reservoirs has a fill connection for providing liquid oxygen from the storage tank to the portable liquid oxygen reservoir. The interior fill station is also provided with a pressure relief valve for connection to the portable liquid oxygen reservoir which is capable of venting to the interior or the exterior of the facility. A liquid oxygen safety relief valve is also provided.

In a further embodiment of the present invention, a pressure regulating mechanism is provided. The pressure regulating mechanism may include one or more pressure relief valves and a pressure build circuit. The pressure build circuit may include one or more pressure relief valves and one or more isolation valves. The pressure build circuit may also include a pressure indicator which indicates the pressure of the oxygen gas in the storage tank and a tank level indicator which indicates the level of liquid oxygen in the storage tank. A vaporizer connected to the storage tank may be provided which vaporizes liquid oxygen in order to increase system pressure.

The gas pipeline distribution network may include a gas control manifold. The gas control manifold may have one or more pressure indicators, one or more isolation valves, and one or more pressure control valves. The gas control manifold may have one or more connections for withdrawal of oxygen gas from the pipeline. In addition, the gas control manifold may include one or more pressure switches, one or more pressure control valves, and one or more check valves.

In a further embodiment of the invention, the liquid oxygen is delivered on a periodic basis (e.g. weekly or monthly) to the liquid oxygen storage tank via the exterior fill station. In this embodiment, the facility is billed a fixed price per period for the delivery of the liquid oxygen. The amount of liquid oxygen which can be delivered for a fixed price is subject to a cap. As is apparent, the delivery and billing periods can be any fixed length of time, such as a month, three months, four months, six months, one year, and the like.

In a further embodiment of the invention, a method of billing for the delivery of liquid oxygen to a liquid oxygen storage tank located inside the facility via an exterior fill station is provided. First, the amount of liquid oxygen used by the facility during a previous period is determined. Next, the amount of liquid oxygen to be used by the facility during a corresponding future period is estimated based on the amount of liquid oxygen used during the previous period. The liquid oxygen is delivered to the facility every period and the facility is charged a fixed price per period for the delivery of liquid oxygen to the facility (without regard for the amount of liquid oxygen actually delivered during that period). The fixed price is calculated based on the estimated amount.

The period may be divided into a number of sub-periods and the fixed price may be divided by the number of sub-periods to provide a fixed price for each sub-period. The facility can then be charged a fixed price per sub-period.

The sub-period can be any predetermined length of time, such as a one month period, a three month period, a six month period, a 12 month period or the like.

The amount of liquid oxygen which can be delivered for a fixed price per period may be subject to a cap.

The cost of rental of the liquid oxygen storage tank may be included in the fixed price. In addition, the cost of rental of any associated equipment may be included in the fixed price. The associated equipment may include portable liquid oxygen reservoirs, portable liquid oxygen tanks or any other similar equipment used with liquid or gaseous oxygen. In addition, the cost of maintenance of the storage tank, exterior fill station, and equipment may be included in the fixed price.

DETAILED DESCRIPTION OF THE INVENTION

The present invention relates to a method and system for the storage and dispensing of medical grade liquid oxygen. In particular, the present invention relates to the storage of medical grade liquid oxygen in a storage tank located within a medical facility which is capable of dispensing liquid oxygen to portable liquid oxygen reservoirs and to portable liquid oxygen tanks, as well as delivering oxygen gas through a gas pineline distribution network. A fixed price billing method is provided for the cost of the liquid oxygen delivered for use in the system.

Figure 1:
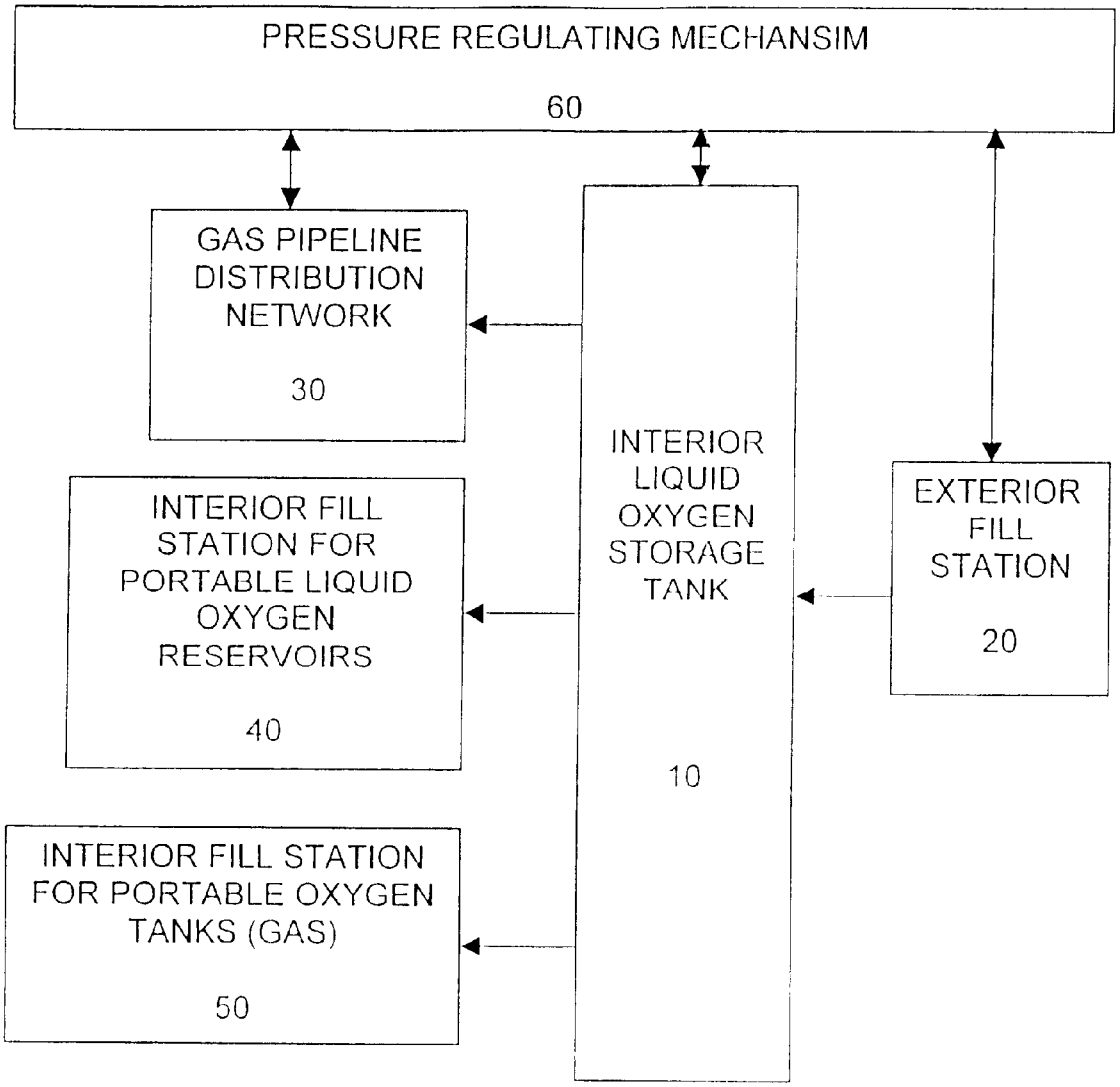
FIG. 1 is a block diagram illustrating the system of the present invention.

In an illustrated embodiment shown in FIG. 1, a medical liquid oxygen storage and dispensing system is provided. A liquid oxygen storage tank 10 is located inside a facility. An exterior fill station 20 is provided on the exterior of the facility and connected to the storage tank 10. A gas pipeline distribution network 30 is connected to the storage tank 10 for delivery of oxygen in gaseous form directly to various locations throughout the facility (e.g. operating rooms, patient rooms, laboratory facilities, and the like). An interior fill station 40 is provided within the facility and connected to the storage tank 10 for dispensing liquid oxygen from the storage tank 10 into portable liquid oxygen reservoirs. A pipeline connecting the interior fill station 40 to the storage tank 10 is provided with a valve mechanism which prevents the liquid oxygen from being completely drained from the storage tank 10. This ensures that a gaseous oxygen supply is provided to the gas pipeline distribution network 30 without interruption. Alternatively, the system may be implemented without the gas pipeline distribution network and valve mechanism.

Figure 2:
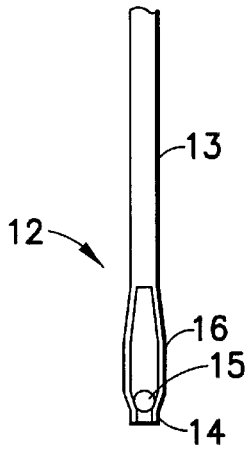
FIG. 2 is an illustration of a float valve utilized with the present invention.

As shown in FIG. 2, the valve mechanism 12 may comprise a dip tube 13 with a float valve 14 disposed at the end of the pipeline which is located inside the storage tank 10 and arranged at a level above a bottom level of the storage tank 10. The float valve 14 may have a float ball 15 and a float ball cage 16. The float valve 14 acts to close the pipeline when the liquid oxygen is drawn down to a preset level by the interior fill station 40. Other known valve mechanisms can be used to the same effect.

The invention also can provide multiple interior fill stations 40 for portable liquid oxygen reservoirs. Interior fill stations 50 (FIG. 1) may also be provided within the facility and connected to the storage tank 10 for dispensing liquid oxygen into portable oxygen tanks (such as portable liquid oxygen tanks carried by patients). These interior fill stations 50 are connected to the storage tank 10 in the same manner as described herein in connection with the interior fill stations for portable liquid oxygen reservoirs 40. The portable liquid oxygen tanks can also be filled with liquid oxygen from the portable liquid oxygen reservoirs.

Figure 3:
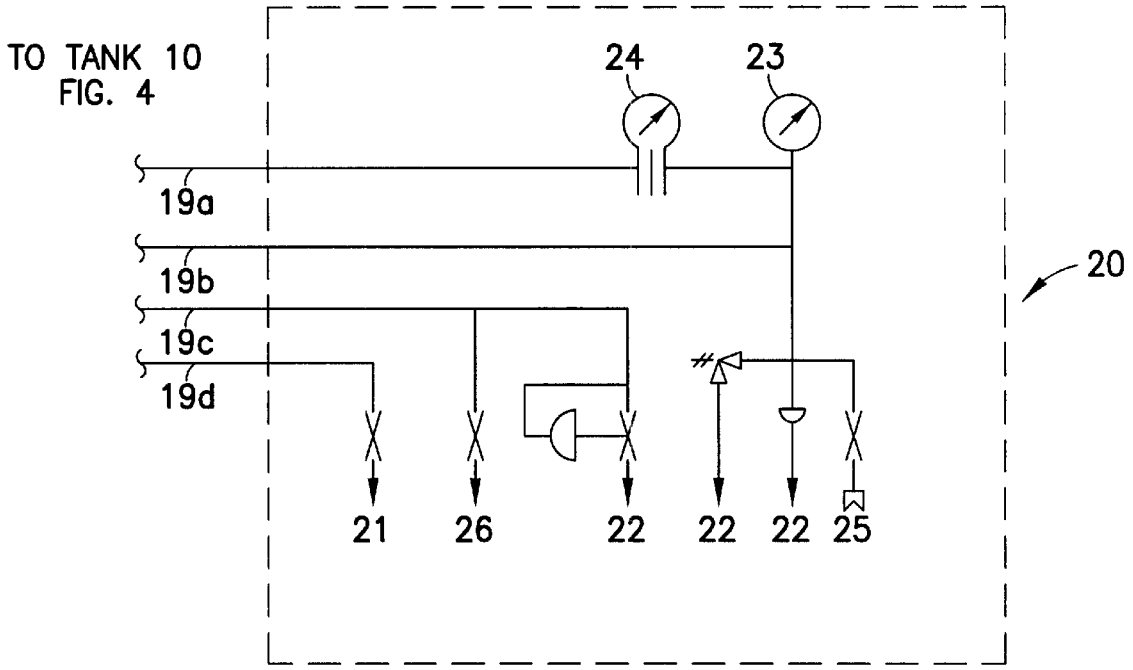
FIG. 3 is a schematic diagram illustrating the exterior fill station of the present invention.

The exterior fill station 20 is shown in detail in FIG. 3. The exterior fill station 20 may be connected to the storage tank 10 and a pressure regulating mechanism 60 by one or more connecting pipelines 19*a*–19*d*. The exterior fill station 20 may have a fill connection 21 for providing liquid oxygen from a delivery truck to the storage tank 10. One or more pressure relief valves 22 may be provided for venting oxygen gas in the event of an overpressure. A pressure indicator 23 is provided which indicates the pressure of the oxygen gas in the storage tank and a tank level indicator 24 is provided which indicates the level of liquid oxygen in the storage tank. A vent/full trycock valve 26 is provided which prevents overfilling of the storage tank 10 with liquid oxygen.

The exterior fill station 20 may also be provided with a sample valve 25 which allows oxygen gas from the storage tank to be withdrawn.

Figure 4:
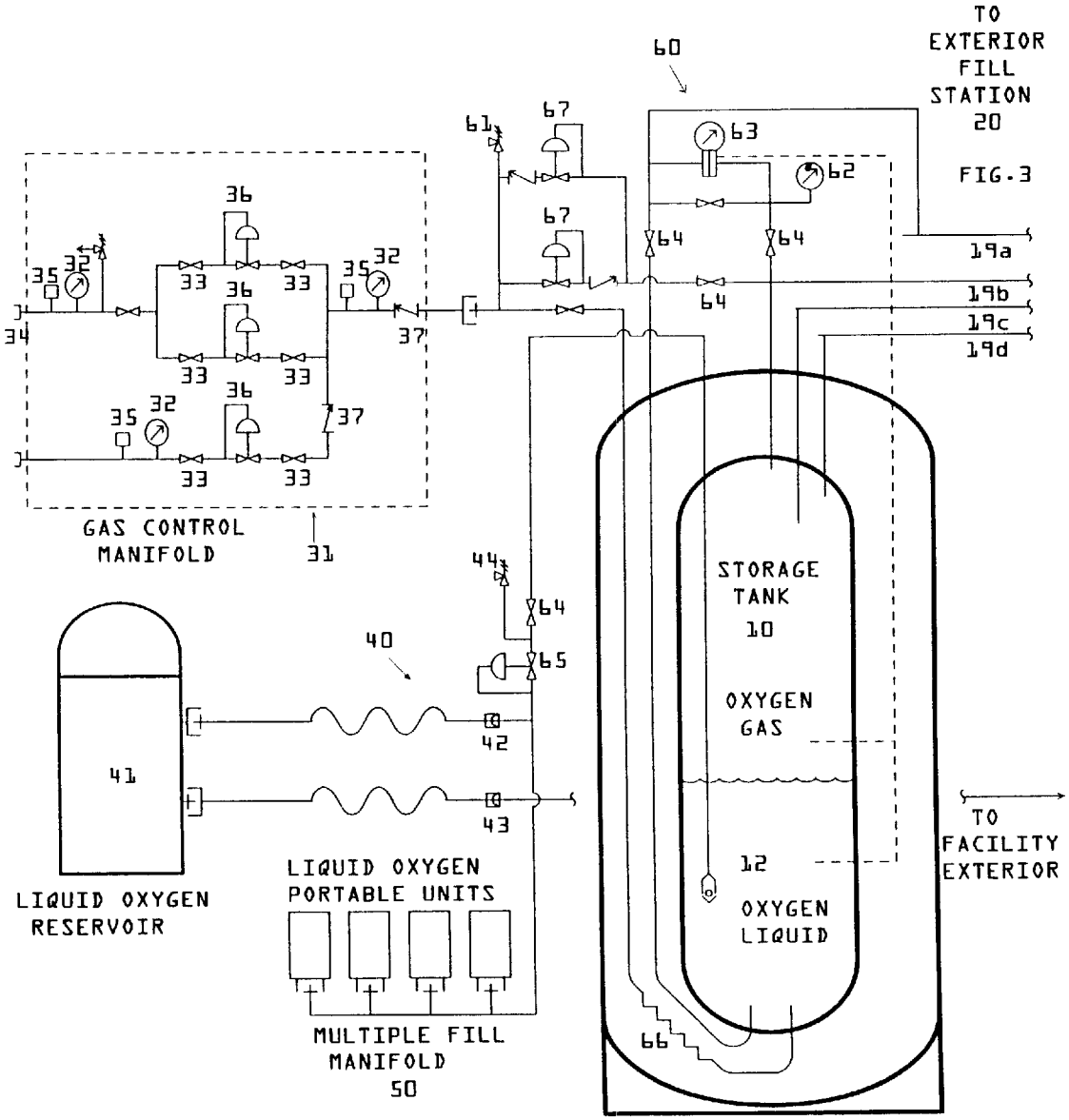
FIG. 4 is a schematic diagram illustrating the system of the present invention in greater detail.

In the detailed illustration of FIG. 4, it can be seen that the interior fill station 40 for dispensing liquid oxygen from the storage tank 10 into portable liquid oxygen reservoirs 41 has a fill connection 42 for providing liquid oxygen from the storage tank 10 to the portable liquid oxygen reservoir 41. The interior fill station 40 is also provided with a pressure relief valve 43 for connection to the portable liquid oxygen reservoir 41. The pressure relief valve 43 may be vented to either the interior or exterior of the facility. A liquid oxygen safety relief valve 44 is also provided.

As shown in FIG. 1, a pressure regulating mechanism 60 may be provided. The pressure regulating mechanism 60 is shown in detail in FIG. 4, and may include one or more pressure relief valves 61 and a pressure build circuit. The pressure build circuit may include one or more pressure relief valves 61, one or more isolation valves 64, and one or more pressure control valves 67. The pressure build circuit may also include a pressure indicator 62 which indicates the pressure of the oxygen gas in the storage tank 10 and a tank level indicator 63 which indicates the level of liquid oxygen in the storage tank 10. A vaporizer 66 connected to the storage tank 10 may be provided which vaporizes liquid oxygen in order to increase system pressure.

The gas pipeline distribution network 30 may include a gas control manifold 31. As shown in FIG. 4, the gas control manifold 31 may have one or more pressure indicators 32 and one or more isolation valves 33. The gas control manifold 31 may have one or more connections 34 for withdrawal of oxygen gas from the pipeline. In addition, the gas control manifold 31 may include one or more pressure switches 35, one or more pressure control valves 36, and one or more check valves 37.

In a further embodiment of the invention, the liquid oxygen is delivered on a periodic basis (e.g. weekly or monthly) to the liquid oxygen storage tank 10 via the exterior fill station 20. In this embodiment, the facility is billed a fixed price per period for the delivery of the liquid oxygen. The amount of liquid oxygen which can be delivered for a fixed price may be subject to a cap. As is apparent, the delivery and billing periods can be any fixed length of time, such as a month, three months, four months, six months, one year, and the like.

In a further embodiment of the invention, a method of billing for the delivery of liquid oxygen to a liquid oxygen storage tank 10 located inside the facility via an exterior fill station 20 is provided. First, the amount of liquid oxygen used by the facility during a previous period is determined. Next, the amount of liquid oxygen be used by the facility during a corresponding future period is estimated based on the amount of liquid oxygen used during the previous period. The liquid oxygen is delivered to the facility every period and the facility is charged a fixed price per period for the delivery of liquid oxygen to the facility (without recard for the amount of liquid oxygen actually delivered during that period). The fixed price is calculated based on the estimated amount.

The period may be divided into a number of sub-periods and the fixed price may be divided by the number of sub-periods to provide a fixed price for each sub-period. The facility can then be charged a fixed price per sub-period.

The sub-period can be any predetermined length of time, such as a one month period, a three month period, a six month period, a 12 month period or the like.

The amount of liquid oxygen which can be delivered for a fixed price may subject to a cap.

The liquid oxygen storage tank 10 may be included in the fixed price. In addition, the cost of rental of any associated equipment may be included in the fixed price. The associated equipment may include portable liquid oxygen reservoirs, portable liquid oxygen tanks, or any other similar equipment used with liquid or gaseous oxygen. In addition, the cost of maintenance of the storage tank 10, exterior fill station 20, and other associated equipment may be included in the fixed price.

It should now be appreciated that the present invention provides an improved method and system for the storage and dispensing of medical liquid oxygen, as well as an improved method and system of billing therefor. In particular, the invention provides economical storage, delivery and billing services to medium sized facilities such as nursing homes or extended care facilities which utilize both liquid and gaseous oxygen but cannot afford to install the very large exterior liquid oxygen tanks used by major hospitals and other healthcare facilities. The invention also provides for increased safety in the storage and dispensing of liquid oxygen.

Although the invention has been described in connection with various preferred embodiments, it should be appreciated that numerous adaptations and modifications can be made thereto without departing from the scope of the invention as set forth in the claims.

What is claimed is:

1. A method of billing for the delivery of liquid oxygen to a facility comprising the steps of:

determining the amount of liquid oxygen used by the facility during a previous period;

estimating the amount of liquid oxygen to be used by the facility during a corresponding future period based on the amount of liquid oxygen used during the previous period;

delivering the liquid oxygen to a liquid oxygen storage tank located inside the facility via an exterior fill station; and charging the facility a fixed price per period for the delivery of liquid oxygen to the facility, said fixed price being calculated based on the estimated amount.

2. A method in accordance with claim 1, wherein;

the period is divided into a number of sub-periods;

the fixed price is divided by the number of sub-periods to provide a fixed price for each sub-period; and the step of charging the facility a fixed price per period comprises charging the facility a fixed price per sub-period.

3. A method in accordance with claim 2, wherein the sub-period is one of a one month period, a three month period, a six month period, or a 12 month period.

4. A method in accordance with claim 1, wherein the amount of liquid oxygen which can be delivered for a fixed price is subject to a cap.

5. A method in accordance with claim 1, wherein:

the cost of rental of the liquid oxygen storage tank is included in the fixed price;

the cost of rental of associated equipment is included in the fixed price, said associated equipment including at least one of portable liquid oxygen reservoirs or portable liquid oxygen tanks; and the cost of maintenance of the storage tank, exterior fill station, and equipment is included in the fixed price.

* * * * *